US009654862B2

(12) United States Patent
Strömbäck

(10) Patent No.: US 9,654,862 B2
(45) Date of Patent: May 16, 2017

(54) ACOUSTIC ELEMENT

(71) Applicant: Lars Strömbäck, Linköping (SE)

(72) Inventor: Lars Strömbäck, Linköping (SE)

( * ) Notice: Subject to any disclaimer, the term of this patent is extended or adjusted under 35 U.S.C. 154(b) by 487 days.

(21) Appl. No.: 14/014,139

(22) Filed: Aug. 29, 2013

(65) Prior Publication Data

US 2014/0003624 A1 Jan. 2, 2014

Related U.S. Application Data

(63) Continuation-in-part of application No. 11/568,179, filed as application No. PCT/SE2005/000579 on Apr. 22, 2005, now abandoned.

(51) Int. Cl.

| | |
|---|---|
| ***H04R 23/00*** | (2006.01) |
| ***H04R 1/22*** | (2006.01) |
| ***F04D 29/30*** | (2006.01) |
| ***F04D 33/00*** | (2006.01) |

(52) U.S. Cl.

CPC ..... *H04R 1/22* (2013.01); *F04D 29/305* (2013.01); *F04D 33/00* (2013.01); *H04R 23/00* (2013.01); *F05D 2270/62* (2013.01)

(58) Field of Classification Search

CPC ..... H04R 23/00; H04R 1/22; F04D 29/263; F04D 29/305; F04D 33/00; G10K 9/00; G10K 11/02; G10K 7/04; G08B 3/00; F05D 2270/62

See application file for complete search history.

(56) References Cited

U.S. PATENT DOCUMENTS

| | | | | |
|---|---|---|---|---|
| 2,304,022 A | | 12/1942 | Sanders | 381/165 |
| 3,058,541 A | | 10/1962 | Leslie | 181/27 |
| 3,695,385 A | | 10/1972 | Sharp | 181/31 |
| 4,198,880 A | | 4/1980 | Leslie | 74/661 |
| RE31,667 E | * | 9/1984 | Knauff | A63H 17/32 318/558 |
| 5,191,618 A | * | 3/1993 | Hisey | H02K 26/00 340/815.87 |
| 6,195,982 B1 | * | 3/2001 | Gysling | F04D 29/668 415/119 |
| 8,804,986 B2 | * | 8/2014 | Donaldson | H04R 9/06 181/175 |

(Continued)

FOREIGN PATENT DOCUMENTS

| | | | |
|---|---|---|---|
| EP | 1191809 | 3/2002 | H04R 9/06 |
| EP | 1209945 | 5/2002 | H04R 9/06 |

(Continued)

OTHER PUBLICATIONS

Japanese Office Action Issued in related application No. 2007-509423, dated Apr. 26, 2011(6 pgs).

(Continued)

*Primary Examiner* — Davetta W Goins
*Assistant Examiner* — Jasmine Pritchard
(74) *Attorney, Agent, or Firm* — Hayes Soloway P.C.

(57) ABSTRACT

A combined fan and loudspeaker element, comprising a motor driven rotor provided with wings or blades, wherein the wings or blades are adjustable in pitch resulting together with a rotation of the rotor in an air transport flow, said wings or blades having superimposed thereon a sound-pitch modulation corresponding to a desired sound-pitch with the rotation of the rotor.

16 Claims, 11 Drawing Sheets

(56) References Cited

U.S. PATENT DOCUMENTS

| | | | | |
|---|---|---|---|---|
| 8,965,024 | B2 * | 2/2015 | Graham | H04R 9/06 181/225 |
| 9,363,611 | B2 * | 6/2016 | Thigpen | H04R 23/00 |
| 2004/0062404 | A1 | 4/2004 | Negishi et al. | 381/77 |

FOREIGN PATENT DOCUMENTS

| | | | |
|---|---|---|---|
| EP | 1365627 | 11/2003 | H04R 9/06 |
| EP | 1016792 | 12/2003 | F04D 29/66 |
| JP | S58141817 | 9/1983 | G01F 1/115 |
| JP | H02287217 | 11/1990 | G01F 1/20 |
| JP | 2004112296 | 4/2004 | H04R 23/00 |
| WO | WO2004030407 | 4/2004 | H04R 11/02 |

OTHER PUBLICATIONS

PCT International Search Report and Written Opinion issued in corresponding application No. PCT/SE2005/000579, dated Jul. 4, 2005 (14 pgs).

* cited by examiner

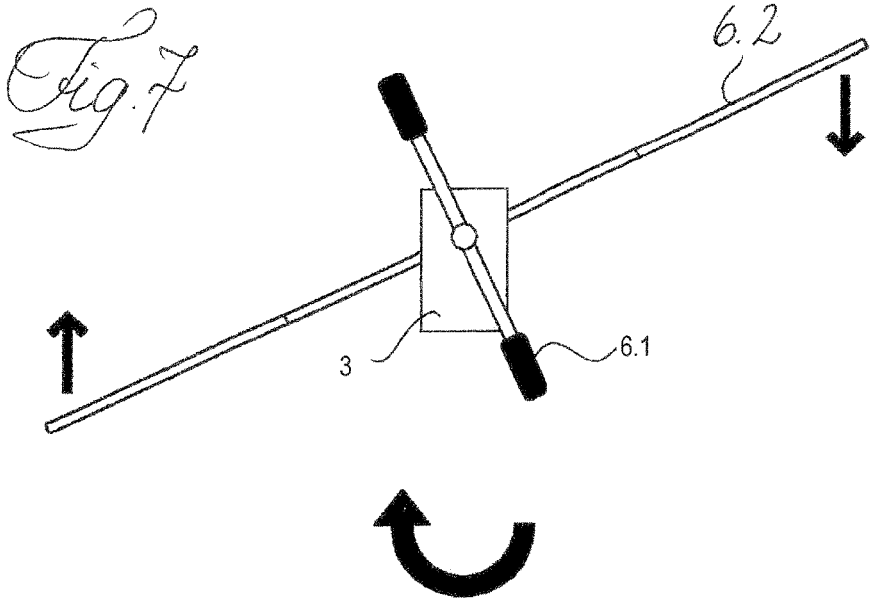
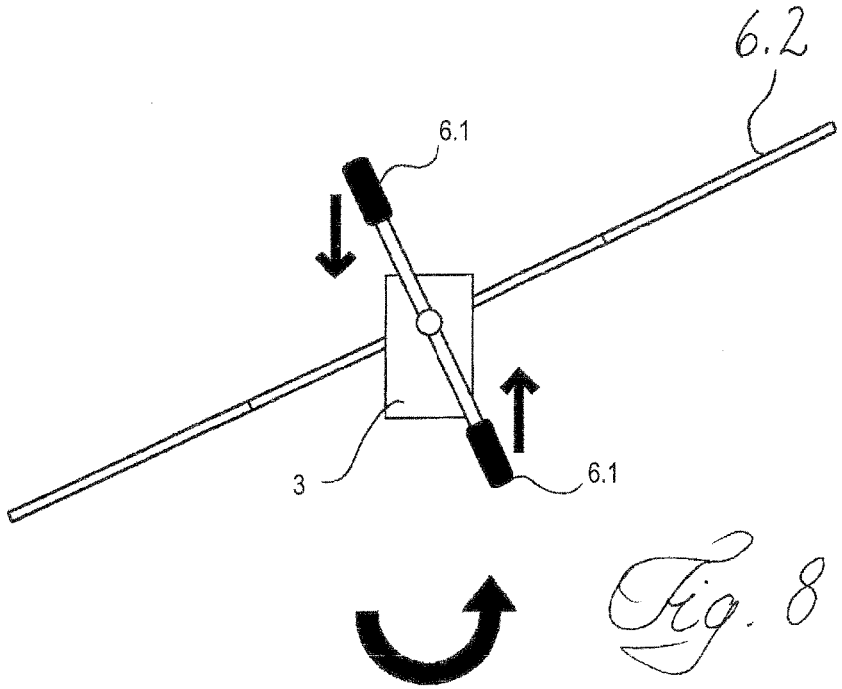
Fig. 8

Fig. 15
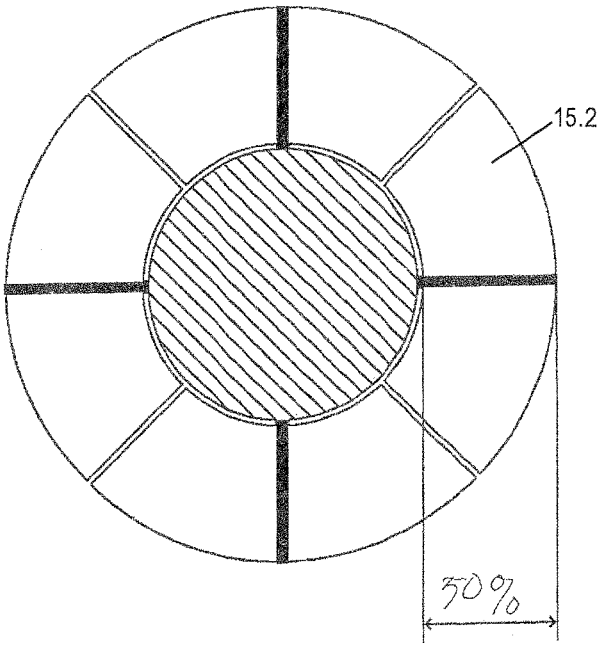
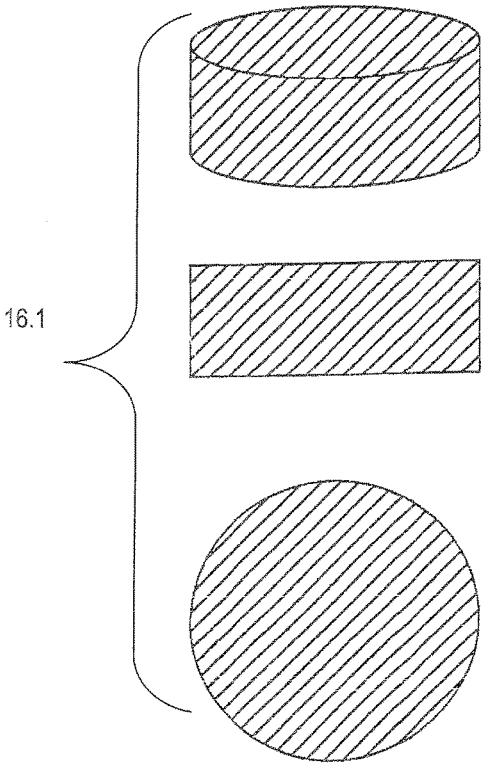
Fig. 16

ACOUSTIC ELEMENT

CROSS REFERENCE TO RELATED APPLICATION

This application is a continuation-in-part of U.S. patent application Ser. No. 11/568,179, filed Oct. 20, 2006, which is a continuation-in-part of PCT International Patent Application Serial No. PCT/SE2005/000579 filed 22 Apr. 2005, designating the United States. Priority is also claimed from Swedish Application Serial No. 0401040-1, filed 23 Apr. 2004.

BACKGROUND OF THE INVENTION

This invention concerns a combined fan and loudspeaker. Fans and Loudspeakers need space and electric connections. More particularly, the invention concerns acoustic elements, as loudspeakers or microphones in particular for lower frequencies. Bass loudspeakers must today in order to achieve a good sound reproduction and strength of sound be large and also frequently become expensive. When the available space is insufficient, as in cars, one simply have to accept that the sound reproduction is afflicted. In view of the above problem there is a great need for improved loudspeakers for lower frequencies. In particular there is a great need for small loudspeaker elements for lower frequencies since in many cases large loudspeakers cannot be installed. The object of the invention is therefor to achieve a compact and efficient loudspeaker and microphone respectively that can cope with low frequencies and that can be made small.

SUMMARY OF THE INVENTION

In accordance with the invention the above object is achieved with a combined fan and loudspeaker element, comprising a motor driven rotor provided with wings or blades, which wings or blades are adjustable to their effective pitch, said effective pitch comprising: a fan-pitch resulting together with the rotation of the rotor in an air transport flow, and superimposed thereto a sound-pitch modulation corresponding to a desired sound generation by the rotation of the rotor with said sound pitch. The wings or blades may be pivotable or flexible to achieve the required adjustments of the effective pitch. By alternating adjust the wings for pushing the air (positive compression) towards the listener and in the opposite direction respectively (negative compression) from the listener the same compression conditions are achieved as at the vibration of a traditional loudspeaker membrane. With an appropriate control of the pitch of the wings desired air transport and sound pressure respectively can be achieved in every instant. By altering the sound-pitch very slowly extremely low frequency sounds can be generated, even below the audible range. The momentary sound pressure of the sound is thus controlled by means of an electric signal to the loudspeaker rotor for control of the sound-pitch of its wings positive signal—positive pressure and flow and negative signal—negative pressure and flow. The sound level of the generated sound can either be controlled by differently great wing angles or by the speed, this since both measures can influence the sound pressure and the transported amount of air respectively in each sound wave.

One can also conceive that the sound level is controlled as a combination of the inclination of the wings of the loudspeaker rotor and the speed respectively. As is realized the reproduced sound must not necessarily be sine shaped but also sound waves compounded of several tones can be generated with the device in accordance with the invention by controlling the wing angles corresponding to the compound desired shape of the sound pressure curve shape.

If more power is desired several rotors according to the invention can be used in parallel alternatively larger rotors may be used. One can also consider to use rotors mounted after each other in order to increase the driving ability, that is the maximally achievable sound pressure. Advantageously one may give the rotors alternating rotation direction and opposed pitch angles in order to decrease turbulence, optimize the airflow and increase efficiency.

By using a rotor with pivotable wings one may instead make a microphone that also may be used for very low tones. By allowing the wings to be freely moveable these may at rotation of the rotor be controlled by the sound inducing airflow back and forth that in a suitable way, for instance optical or electrical way can be detected by a detecting of the angle displacement of the wings.

One can also consider to use the invention in other media than air, for instance water, to generate sound waves or acoustic phenomena.

BRIEF DESCRIPTION OF THE DRAWINGS

Further advantages and characteristics of the invention as well as further developments of the invented concept are apparent from the patent claims and the following described embodiment with reference to the enclosed drawings.

FIG. 5 shows schematically a loudspeaker rotor in accordance with the invention that is driven by a motor.

FIG. 8 shows the compensation forces that is generated by the centrifugal force.

FIG. 15 shows a rotor with blades smaller than 80% of the rotor radius.

FIG. 16 shows the outer wall (tube) form different angles.

DETAILED DESCRIPTION OF PREFERRED EMBODIMENTS

Figure 1:
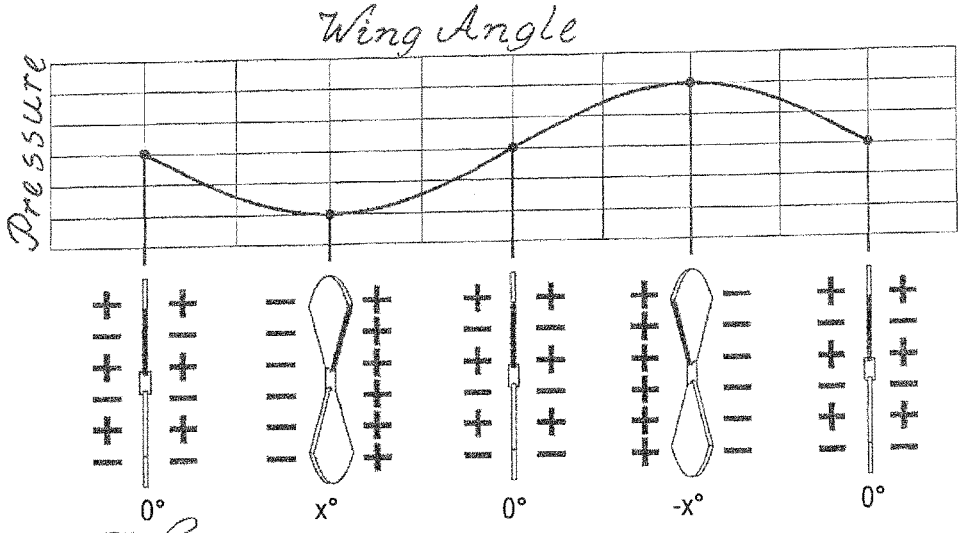
FIG. 1 shows schematically the relation between wing angle and sound pressure graph.
Figure 2:
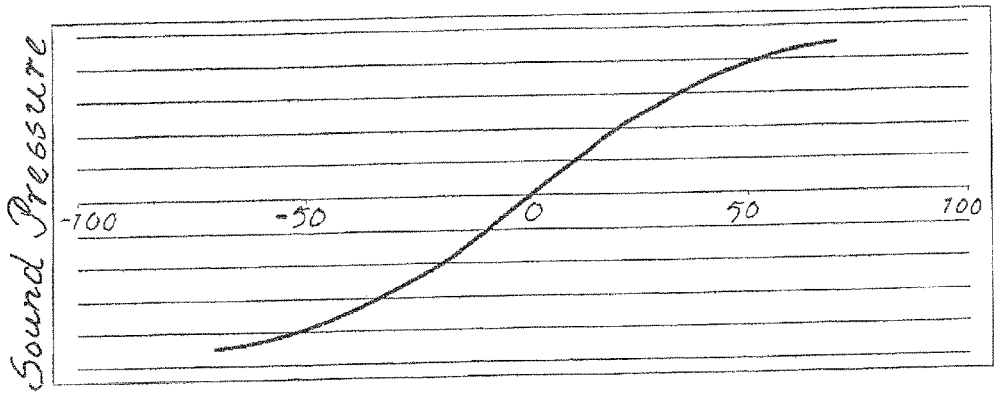
FIG. 2 shows how the wing angle is varied with a varying sound pressure as a result.
Figure 3:
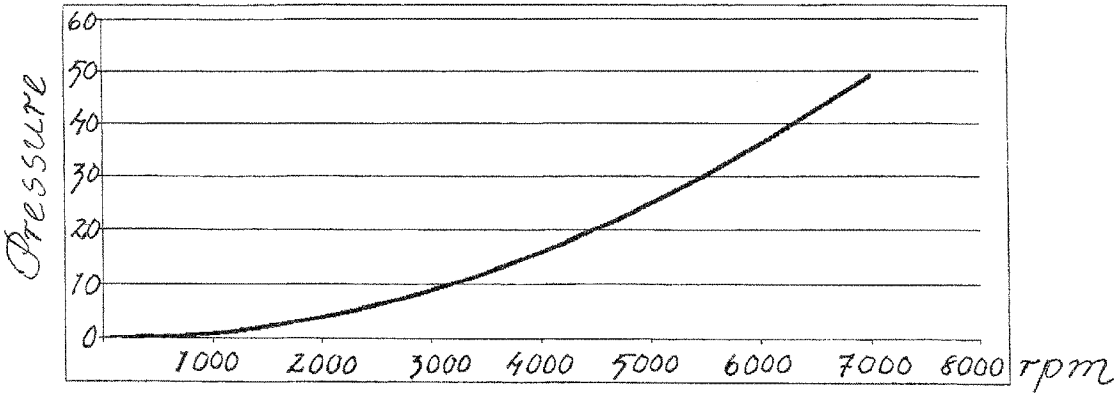
FIG. 3 shows the relation between sound pressure and r.p.m.
Figure 4:
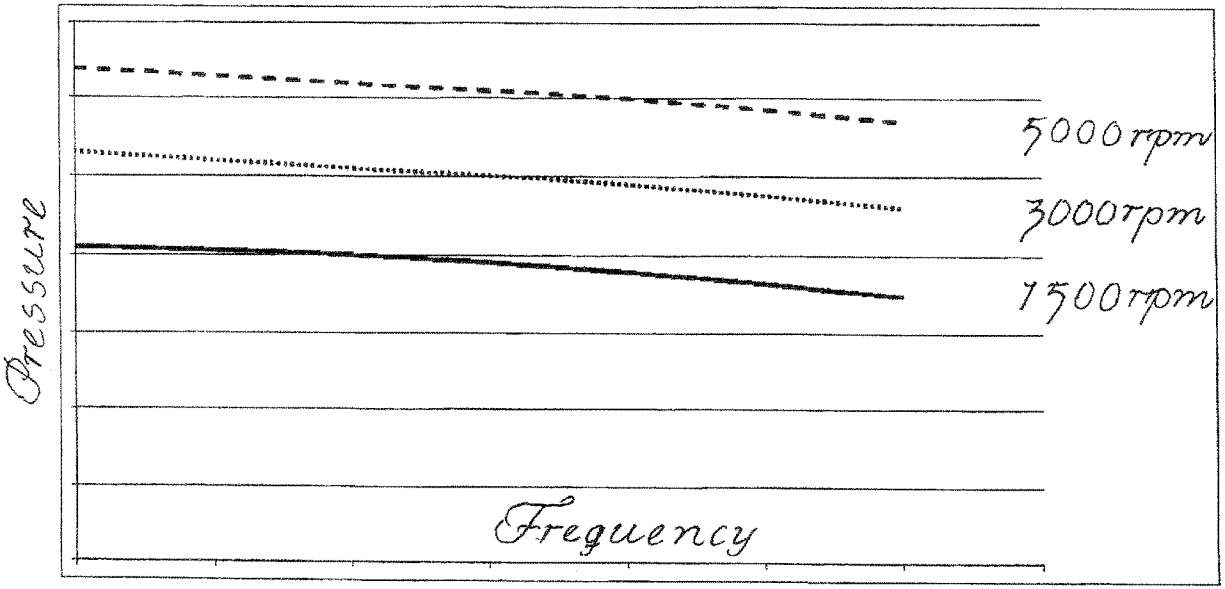
FIG. 4 shows the relation between sound pressure and frequency at different r.p.m:s

The element shown in FIG. 5 in accordance with the invention includes a direct driven rotor, that is the rotor is arranged directly on the motor axle of a motor. The rotor has in this example three wings 2, which in their inner ends are pivotable arranged in a hub 3. The wings are pivotable around essentially radial pivot axles 4. The hub 3 is rotated by the motor 1. Each wing in this example has an area corresponding to approximately one third of a circle ring and is in the inner end at a distance from the pivot bearing via an arm 7 connected to a coil axially moveable relative the rotor so that a an axial movement of the coil 5 pivots the wings. The coil 5 is surrounded by a fixed permanent magnet 6 and is fed with electricity against the influence of restraining springs no that it is moved forwards or backwards depending on the direction of electrical current. Advantageously the pivot axles of the wings are situated slightly in front of the pressure center (approximately the center of gravity of the wing area) so that the wings moves towards a center position without driving of the air when the coil is not fed with electric current. At the same time the required forces for the pivoting of the wings around the pivot axles of these become very small. This condition can either be used for sound amplifying alternatively to compensate a possible week coupling, caused by the construction, between magnets and coil in the wing maneuvering.

For the generation of sound an electrical signal is applied to the coil that owing to this swing back and forth. The movement is via the arms linked to the wings at which the wing angle is altered in a corresponding way. Energy for the moving of air forth and back, that is the sound generation is supplied by the motor driving the loudspeaker rotor. As a consequence of this the loudspeaker element according to the invention will function as a power amplifier.

With decreasing sound frequency the number of revolutions that the loud speaker rotor rotates during a sound wave length will increase which increases the transported amount of air and thus the sound pressure can be retained at low frequencies differing from the case at ordinary loudspeakers. The device according to the invention can principally generate sounds of arbitrary low frequency. For sound waves with higher frequency the wings of the loudspeaker rotor should not be too heavy. One can therefore consider to use many smaller wings as in a turbine or to fabricate comparatively small elements that when more power is needed can be put together in panels. Furthermore the element in accordance with the invention can be arranged together with loudspeaker elements of conventional type in order to achieve a sufficient frequency range. Within the frame of the inventive thought the maneuvering of the element rotor can be designed in different ways as to the journaling of the wings.

The maneuvering can be electromagnetic with one or several magnets fixed to the wings or these may be magnetic in themselves in order to be influenced by a fixed coil. Alternatively a coil arranged in the rotor may mechanically influence the wings when the current through the coil is altered and this is located in a fixed magnetic field generated by a fixed permanent magnet. Each wing may be provided with one or several coils as alternative. One may also consider to control the wings via a piston or coil placed in the center of the rotor where the inner part of the wing has a mechanical coupling to the piston or coil. Also the fastening of the wings and journaling thereof can be achieved in different ways and one can for instance consider the element rotor being made of thin iron panel that has been punched, embossed and magnetized, and surrounded by one or several fixed coils. Within the concept of the invention one can also consider to use other physical phenomena to achieve the required pivoting/bending of the wings of the rotor, as for instance piezoelectric elements.

The element rotor need not necessarily be flat or propeller like as above but one can also consider to use a drumlike device with blades adjustable to their angles.

The element rotor in accordance with the invention is also a fan why one can use it for the transportation of air for ventilation purposes. This can be done by instead of varying the pitch of the wings giving these a constant fan pitch (for the time that ventilation is desired). The element rotor then only serves as a fan. If one instead choose to allow the sound-pitch to vary with intended sound signals, but not around the center position where the rotor does not transport any air but around a fan pitch position, fan and loudspeaker function is obtained at the same time.

The combined fan and loud speaker element in accordance with the invention can also be arranged in a ventilation outlet by journaling the wings freely moveable with the journaling axle somewhat in front of the pressure center, and with electromagnetic pitch control. This can for instance be done by providing the wings at their outer edges with magnets with circumferential extension. Outside a coil is placed around loud speaker rotor. With an increasing amount of air that is pushed through the loudspeaker rotor by the ventilation system the wings of the rotor will deflect from their middle position, the electromechanically enforced additional angling of the wings will oscillate around the ventilation angling so that the sound is generated independent of the ventilation. By the integration with the ventilation system automatically a discrete mounting is obtained and large parts corresponding to loudspeaker boxes (in the shape of the air conduits) which reduces the distortion of the sound. In particular in cars this may mean a considerable improvement of the sound quality.

In the above described embodiment the motor is coupled directly to the element rotor, but if so desired one can also consider belt drive. Either with one rotor per motor or several rotors that are in common driven by one motor. Also several rotors may be arranged on one and the same axle to increase the acoustic driveability. The wing pitch may in a corresponding way be controlled in common or individually for several rotors. The lead rotors may further be driven by power net connected motors while the wing angle is controlled by signals from sound amplifiers. At this the need for powerful amplifiers as well as thick and low-ohmic connections between amplifier and bass loudspeakers is reduced.

Since elements in accordance with the invention can let through an air flow the wind resistance at outdoor locations is reduced, this counter acts the pressure variations that otherwise arise. A more natural sound with better sound quality can therefor be achieved outdoors.

In addition to generate audible sound, elements in accordance with the invention can be used to generate infrasounds. In this way it becomes possible to annihilate existing infrasounds which has previously been a problem especially in view of infrasound being able to result in nausea, headache and cause drivers to fall a sleep.

If no force is fed to the wings for the pivoting of these when the rotor is rotated the wings alter their inclination according to the flow so that the resistance become as small as possible and one can by recording the varying pitch of the wings for instance by connecting the coil to a measuring instrument alternatively optically register the wing pitch so that a "loudspeaker rotor" instead may function as a microphone in particular for low frequencies even if a superimposed constant air flow is present. If sound is to be detected in a constant flow the wings work with a constant pitch corresponding to the constant flow. Around this zero position the wings pivot at the detection of sound or flow variations. The microphone in accordance with invention has the advantage that it already before the detection separates the constant flow component from the varying one which reduces the noise in the measured sound. If so is desired the average flow may be detected by noting the mean pivoting of the wing pitch.

Advantageously the rotor is driven at a constant speed or at least with monitored or controlled rpm since the rotor speed has a large influence on the generated sound amplitude and the instant sound power. One can also consider providing the rotor with a flywheel or a large rotating mass in order to provide a steady constant rotation even if the wing pitch and thereby the braking is changed due to the delivered sound volume. The motor can also be provided with active control where a speed control compensate the speed variations that load variations may generate.

One can also use motors with constant speed or drive the motor with a power addition corresponding to the delivered sound. One can also consider instead to monitor the speed so that the reduction in speed can be compensated with increased wing deflection so that intended sound pressure can be generated.

Since the angle of the wings directly modulate the sound pressure one may advantageously use active feedback to ascertain blade angle. The angle detection can then be implemented with optical/piezoelectrical or electromechanical sensors.

Figure 12:
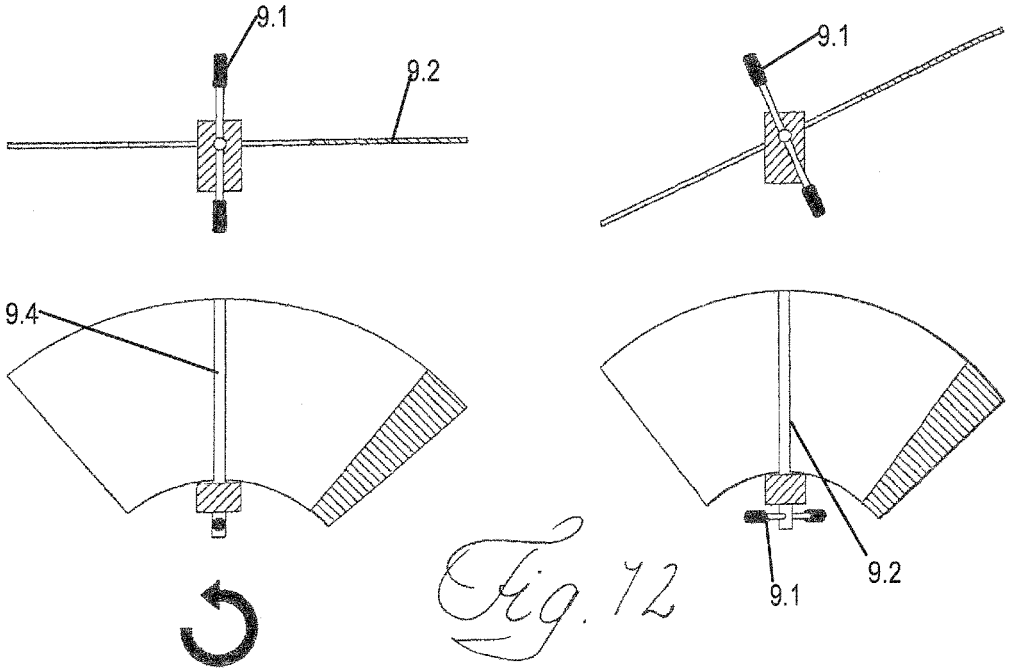
FIG. 12 shows blade with extra wing area for force linearizing.
Figure 13:
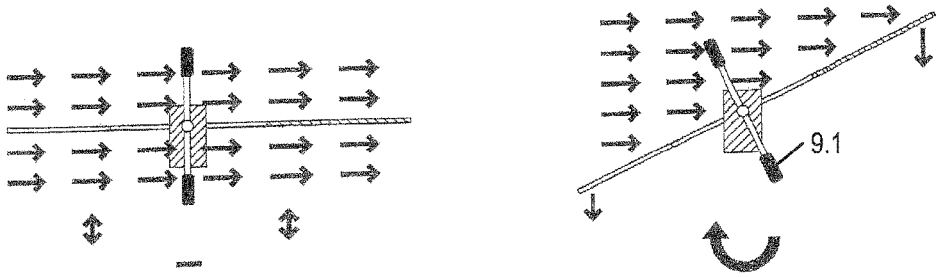
FIG. 13 shows the modulation forces at angled and non angled state for force linearizing.

In FIG. 5 the pivot axles 4 of the wings 2 are arranged unsymmetrically on the wings of the rotor. The rotor rotates clockwise. This result in the pushing force on that half of the wing that is behind the pivoting center is slightly larger than the pressure on the wing part that is in front of the pivot axle half and the wing will thus always generate a counter force against an increased pivoting. This in turn means that the larger pivoting or pitch for the wing that is to be desired the more power must be applied and in this way a linear acoustic response is obtained from the rotor and the wing pitch can be controlled through force influence (FIGS. 12, 13).

Figure 6:
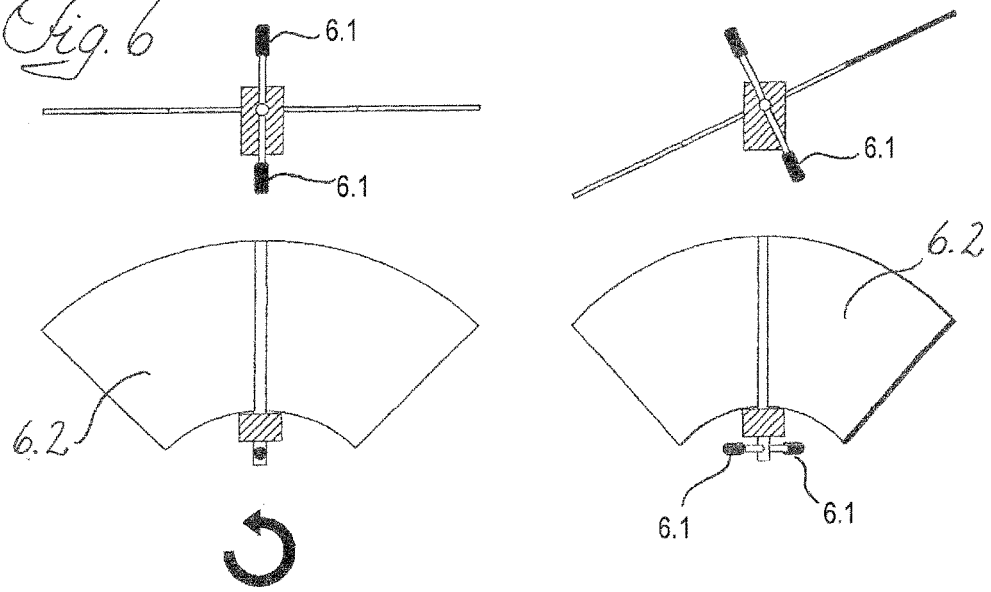
FIG. 6 shows wings and compensation weights at force balancing via centrifugal force.
Figure 7:
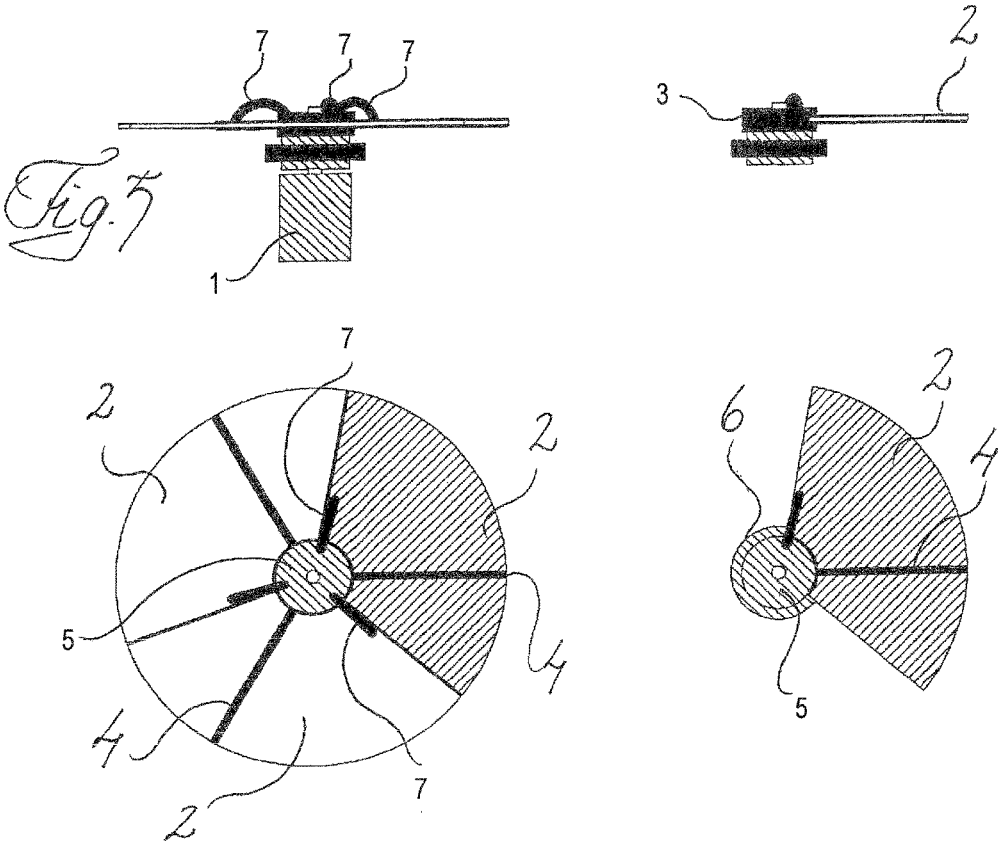
FIG. 7 shows the wing forces that is generated by the centrifugal force.
Figure 9:
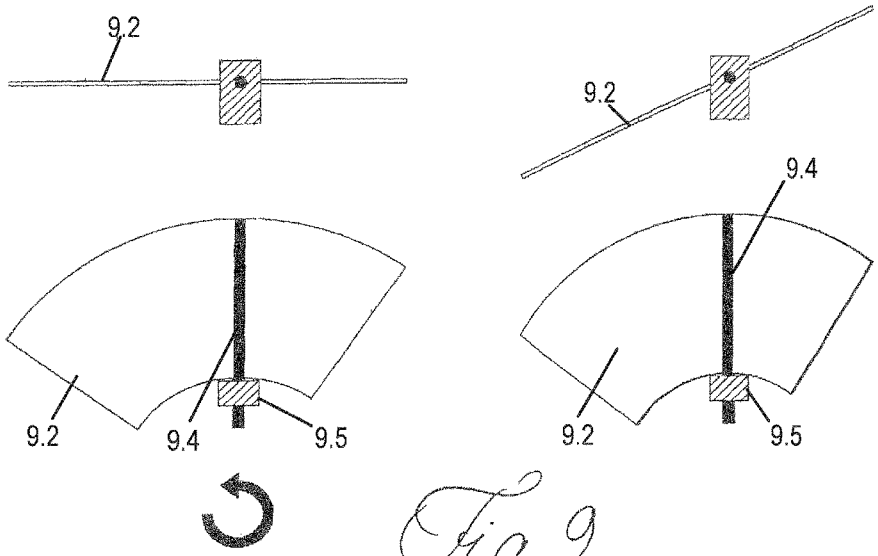
FIG. 9 shows schematically the wing design at force balancing via asymmetric wing design.

When the wings of the rotor from an entirely flat position is given an increased angle the pivoting of each wing takes place around its own axle. At a rotor with wider wings as for instance the one shown in FIG. 5 the wing tips will move perpendicularly inward towards the pivot axles of the wings, that is also inward towards the rotational center of the rotor. The wings must thus move against the influence of the centrifugal force that acts on the wings. At high rotor speeds these centrifugal forces may be become most considerable and they brake the electrical deflection of the motor wings. This increase the power consumption in an undesired way. In order to remedy this as is shown in FIG. 6 balance element or weights 6.1 are arranged perpendicularly relative the area of the wings 6.2. The balance elements have the shape of arms perpendicular to the surface of the blade fastened for instance in the inner ends of the wing axles provided with weights in their outer ends. These weights will as the wing tips move perpendicularly in relation to the pivot axles of the wings. Through the perpendicular arrangement these weights will at a pivoting of the wing move radially outward in relation to the rotor axle. By appropriate dimensioning of the weights 6.1 it is possible to achieve centrifugal forces (FIG. 8) that balance the centrifugal forces from the wings (FIG. 7) efficiently reducing the control forces that otherwise must be delivered to the wings (FIGS. 6, 7, 8).

Figure 10:
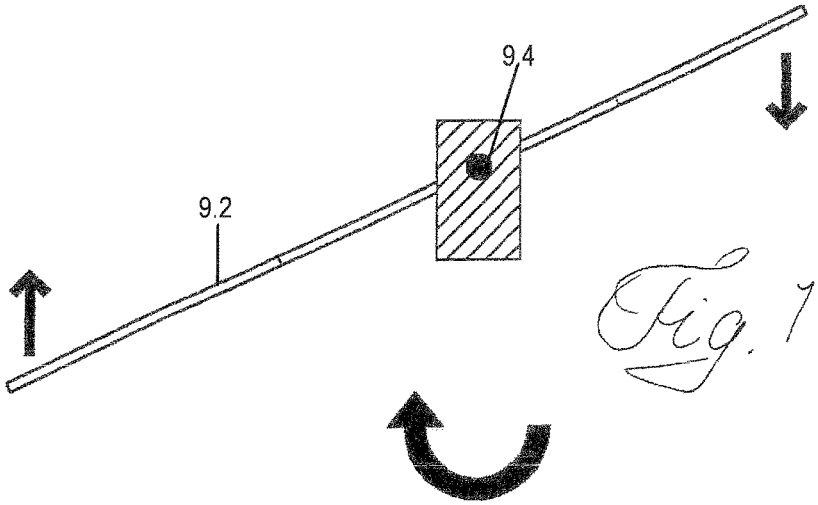
FIG. 10 shows the wing forces and the pivoting force generated by the centrifugal force.
Figure 11:
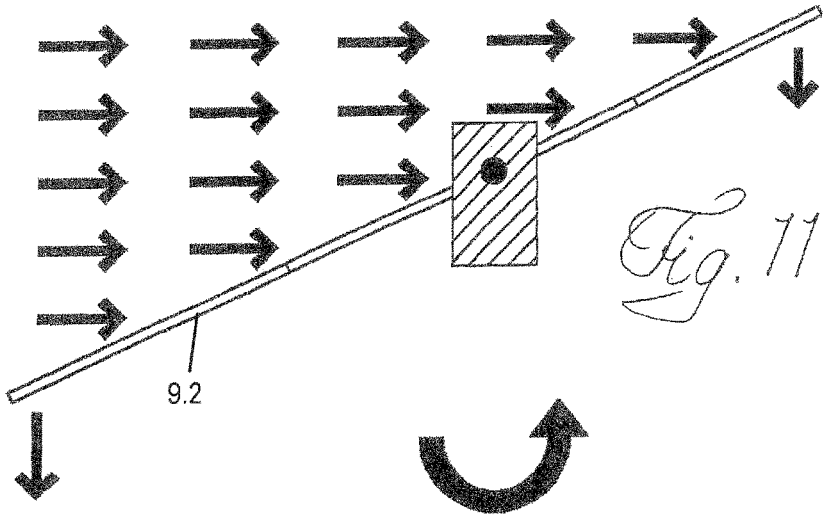
FIG. 11 shows the compensation forces from wind and the pivot force that is generated by the asymmetric wing design.

By designing the wing 9.2 unsymmetrically (FIG. 9), appropriate dimensioning of the weights 9.1, and placing the pivot axle 9.4 of each wing 9.2 behind the center of pressure seen in the rotational direction also force generated by the unsymmetry (FIG. 11) may be used to compensate the pivoting generated by the centrifugal force (FIG. 10). (FIGS. 9, 10, 11, 12, 13).

Figure 17:
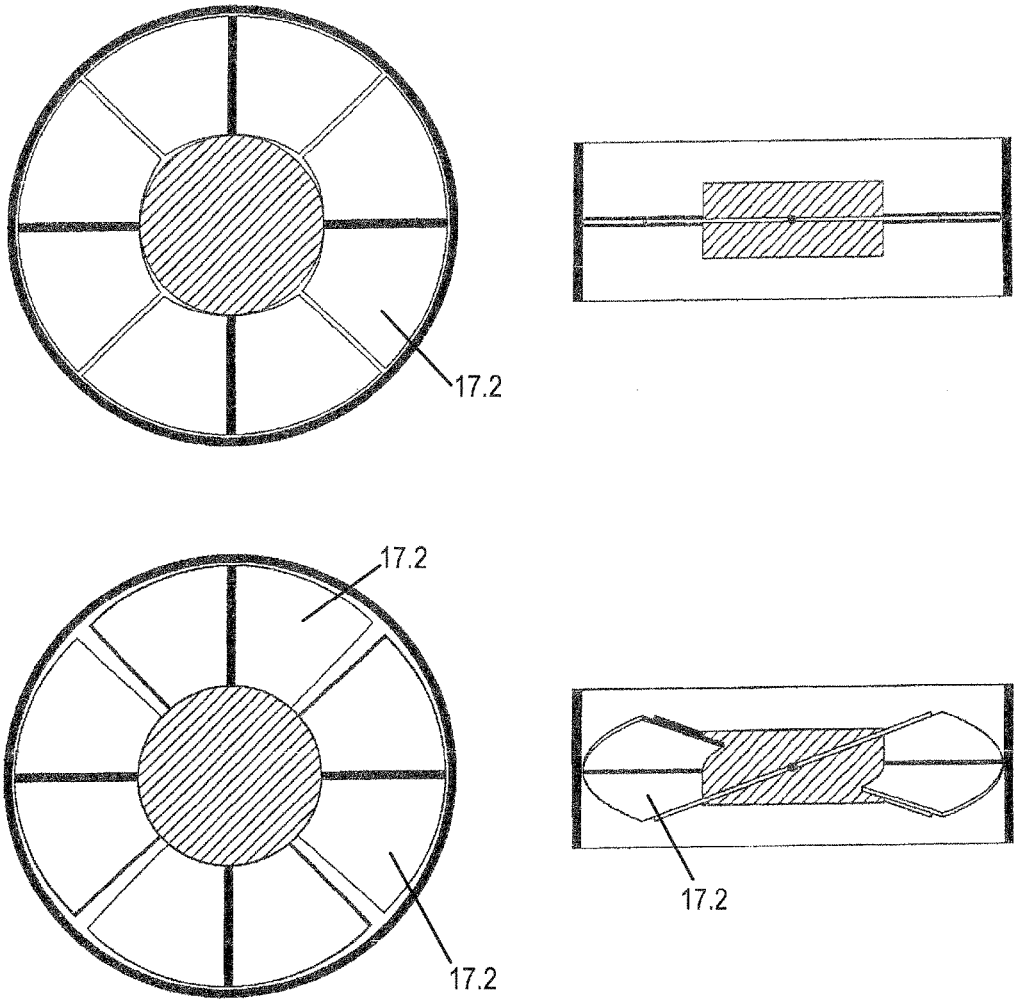
FIG. 17 shows the rotor mounted in the tube without seals with angled and non angled wings.
Figure 18:
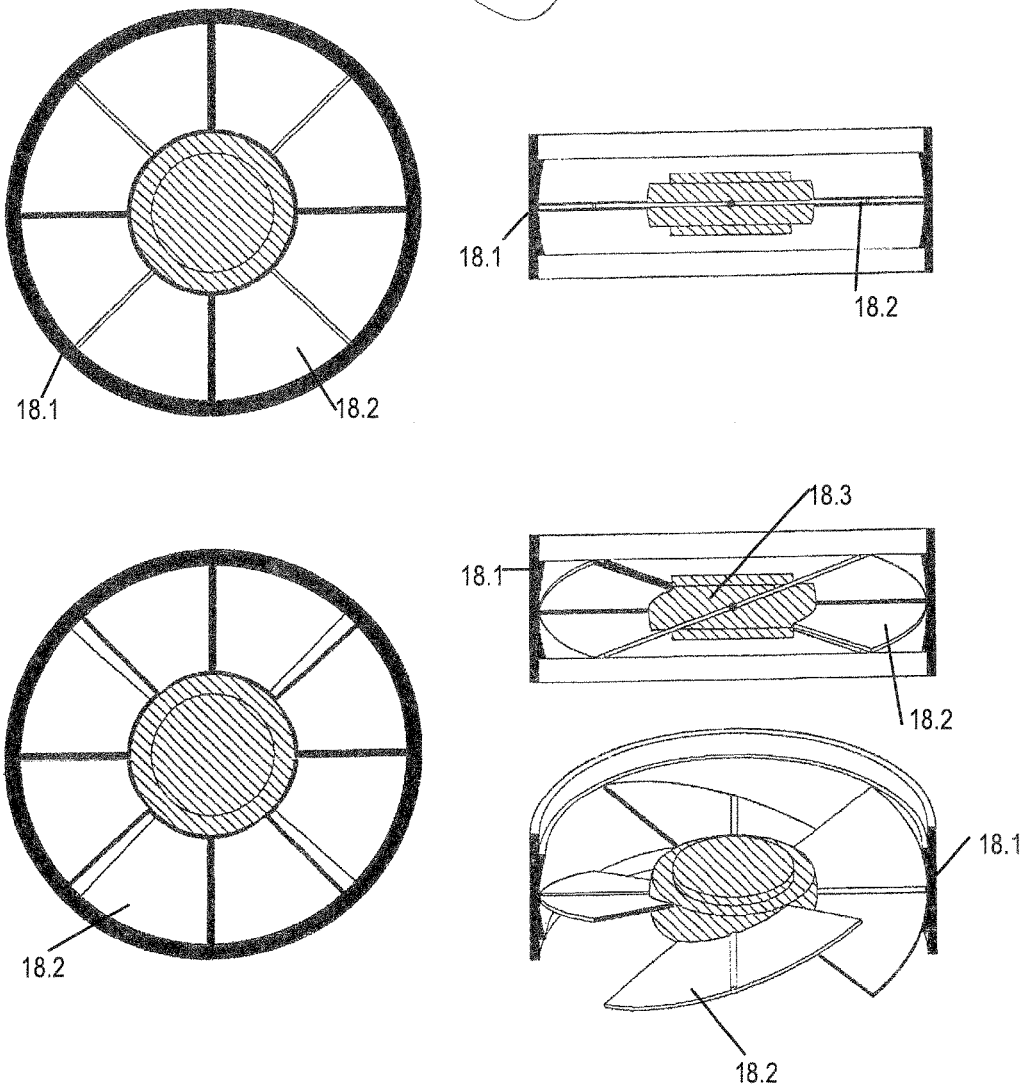
FIG. 18 shows the rotor mounted in the tube with spherically cut seals with angled and non angled wings.

In order to prevent air transport between the sides of the rotor at its outer end this is advantageously arranged in a tube or corresponding housing 16.1 (FIG. 16). As described above with reference to FIG. 17 however the outer corners of the wings 17.2 move inward as the pitch is increased. At the same time the inner corners move outward. This cause leakage between the front and back side of the rotor, which impairs the efficiency of the device. Therefore the rotor blades 18.2 and the surrounding housing 18.1 and the rotor hub 18.3 respectively are designed in the way shown in FIG. 18. The sealing surface in the housing 18.1 surrounding the rotor is shaped spherical with the center of the spherical surface in the center of the rotor where the pivot axles of the wings intersect the rotor axle. At a pivoting of the wings the circular outer edges of the wings will then all the time lie close to the inner surface of the housing.

Figure 19:
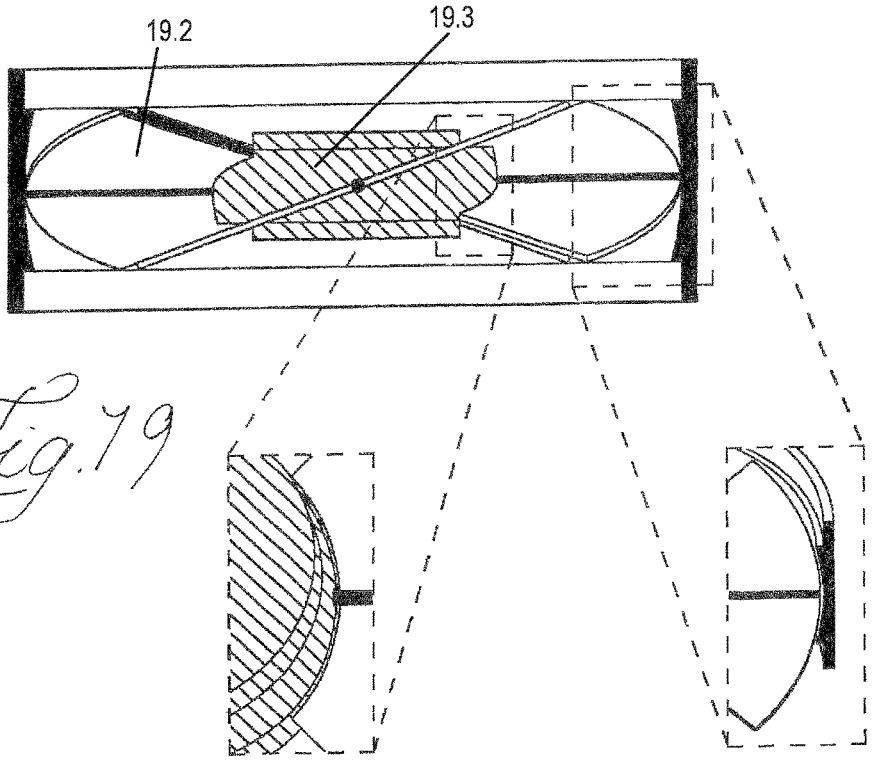
FIG. 19 shows a close up of the rotor mounted in the tube with spherically cut seals.
Figure 20:
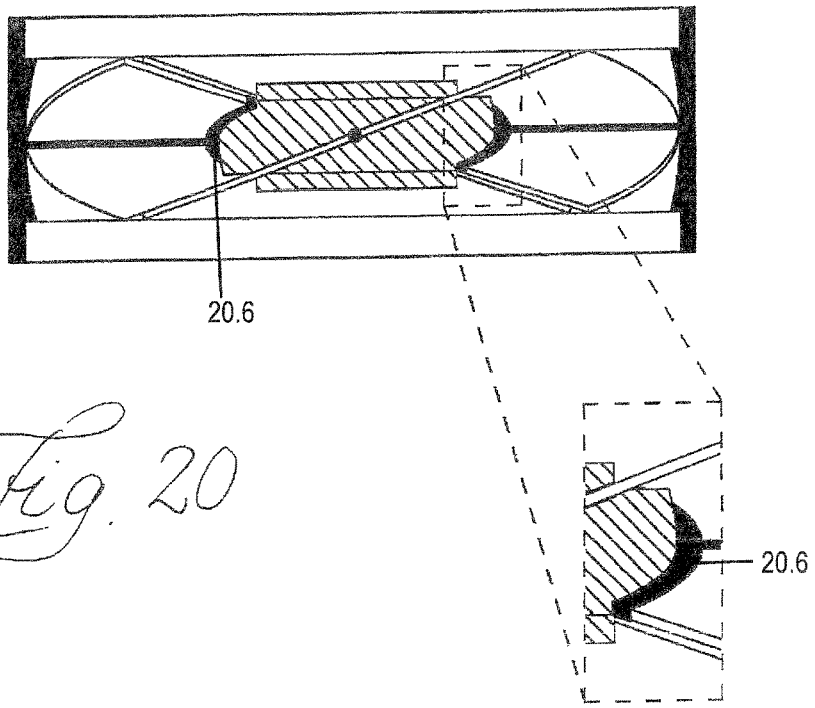
FIG. 20 shows a close up of the rotor mounted in the tube with spherically cut seals and bellow seal.

At the inner edges of the wings 19.2 also the hub 19.3 of the rotor is made with a rotational symmetric sealing surface and a corresponding shaping of the inner edges of the wings to achieve a sealed condition (FIG. 19). By also here using a spherical sealing surface on the hub with the center on the rotation axle of the rotor and with a correspondingly curved inner edge of the wing, at which the center of the spherical surface lies on the pivot axle. In this way also the hub in its entirety can be rotationally symmetric. Since there is no mutual rotation at the inner edges 20.6 but only pivoting the seal may here be established in some other way, for instance with a below like device (FIG. 20). (FIGS. 16, 17, 18, 19, 20)

Figure 14:
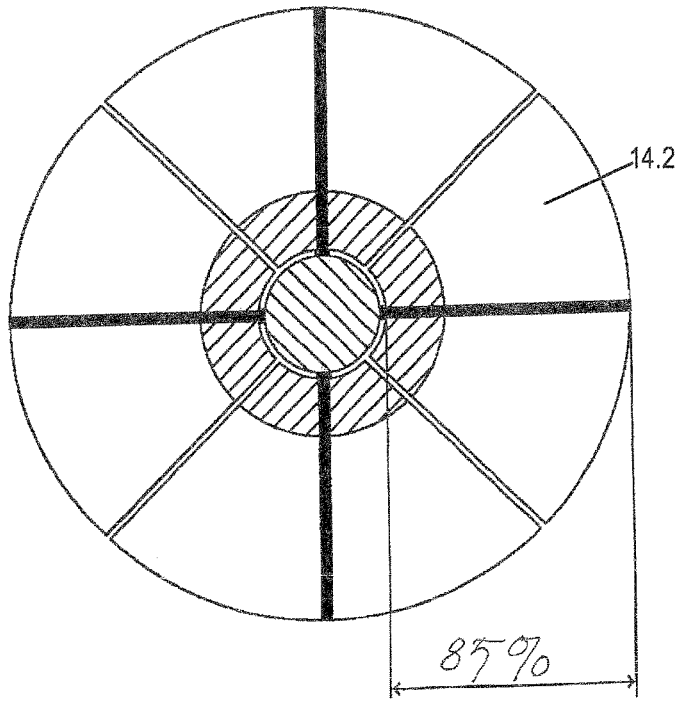
FIG. 14 shows a rotor with blades larger than 80% of the rotor radius, area subjected to pressure loss is marked.

Since the efficiency of the component largely is ruled by how well the pressure is built up the blades primarily have to be designed for pressure and not for flow. The largest pressure build up takes place where the blade velocity is as largest. Low blade velocity result in leakage at high pressure and reduced efficiency. This means that the blades should have a blade velocity as high as possible for good efficiency in pressure building. Since the blade velocity is low in the center of the rotor this means that leakage will occur if the blades reach all the way in. A solution to this problem is to design smaller blades and allow the kernel to cover the part where the blade velocity is too low. For efficient build up the blades must be less than 80% of the radius of the rotor. In FIG. 14 a rotor is shown with wings 14.2 larger than 80% of the rotor radius, the area subjected to pressure loss is marked. In FIG. 15 a rotor is shown with wing 15.2 smaller than 80%. of the rotor radius. (FIGS. 14, 15)

In order to further increase the efficiency at the pressure build up several layers of blades may be designed in the rotor. One can also consider to mount rotors after each other. Since the rotation generates a rotation phenomena in the modulated media (e.g. air) one may advantageously allow the rotors to rotate in alternating rotational directions since this leads to the rotors being able to use the rotation phenomena occurring in the media (e.g. air).

The invention can be used at all types of elements that with a rotating movement can transport air (or liquid), that is also radial fans, tangential fans, turbines et cetera in turbines one may advantageously by integration of the technique use the technique in the turbine steps. In many situations disturbing sound is generated by rotating air transporting elements and by means of the invention one may consider to reduce these either by the arranging of an extra rotor propeller et cetera or by controlling the rotating element that generate the sound, this in particular since these sounds often are continues.

The pitch of a wing is in principle the angle of the wing in relation to its plane of rotation. Since however the shape of the wing or blade may influence for instance the air transporting the shape of the wing may increase or decrease the actual pitch to what we could call effective pitch. Consequently pitch modulations may be achieved with a modulation of the shape of the wings, for instance by means of large piezoelectric elements.

The invention may even be put to use at wind driven generators where a large wing provided rotor is rotated by the wind. The blades may have a fixed basic pitch corresponding to that of a normal rotor but provided with means allowing modulation around or from this basic pitch. Here the modulations may in particular be used to reduce sound. Also the basic pitch may be controlled by control means that are independent of the means for modulating the wing pitch. With so large wings the conditions may vary over the turn of the rotor due to different wind speed at the top and bottom as well as the passing of the mast and one may consider to vary the modulation over the turn of the rotor.

In practical tests it has been discovered that when modulating the pitch of the blades to reduce sound also the efficiency of the fan or power generation has improved. This phenomena may also be used to control the modulation, that is controlled to give maximum power from a connected generator.

It also deserves to be mentioned that the principles of the invention are very possible to apply widely with regard to the acoustic frequency as well as different air speeds and sizes of the devices.

Since the invented concept as described above is possible to use as an acoustic wave generator as well as a microphone these functions can be combined in the same device that on to say can feel its way to the correct modulation in order to achieve for instance sound inhibiting or attenuation. Alternatively an external microphone that may or may not be of the same type be used to obtain a feedback that can be used to minimize the sound. Such a sound reduction will be very efficient since the noise is reduced at the source.

The invention claimed is:

1. A combined fan and loudspeaker clement, comprising a motor driven rotor provided with wings or blades, wherein the wings or blades are adjustable in pitch resulting together with a rotation of the rotor air transport flow through the rotor and the blades, said wings or blades having superimposed thereon a sound-pitch modulation corresponding to a desired sound-signal, said element further comprising a microphone for providing feedback to minimize or inhibit sound from the element.

2. The element according to claim 1, wherein permanent magnets are arranged on or integrated with blades or wings, and a fixed coil or coils are arranged for influencing the magnets for pivoting the wings or blades.

3. The element according to claim 2, wherein the wings have integrated coils.

4. The element according to claim 1, further comprising a piezo element for altering of a pitch of the wings or blades.

5. The element according to claim 1, wherein each wing or blade has a pivot axis and a balance centre for a pressure with which said wing or blade press against the air, said balance centre lying behind the pivot axis of the element in a movement direction of the wing or blade when the rotor is rotated so that an increasing pitch requires an increasing adjustment force to enable a precise pitch control.

6. The element according to claim 1, further comprising a flywheel or active speed control for compensating load dependent speed variations caused by signal modulated wing angles.

7. The element according to claim 1, wherein the wing pitch is controlled with active feedback.

8. The element according to claim 1, comprising a circular rotor provided with one or several wings.

9. The element according to claim 5, comprising a circular rotor provided with one or several wings.

10. The element according to claim 1, further comprising a first sensor or control for controlling a fan-pitch value, and a second sensor or control for controlling modulation around said fan-pitch value, the first sensor or control corresponding to air volume or power, and the second sensor or control corresponding to the sound that is sensed or generated.

11. The element according to claim 1, wherein the wings or blades pitch is set at fabrication of the rotor.

12. The element according to claim 1, wherein the wings or blades pitch modulation is achieved by a modulation of the shape of the wings or blades of the rotor.

13. The element according to claim 1, wherein the wings or the blades have a pivot axle and a balance centre for a pressure with which said wings press against the air, said balance centre lying in front of the pivot axle in the movement direction of rotation so that with the pitch angle varying centrifugal forces on the wings are compensated.

14. The element according to claim 1, wherein a pivoting center for the sound pitch is located in front of a symmetry line or a balance point of a wing area so that a rear area of the wing becomes larger and thereby provides increasing resistance against increasing pitch so that improved linearity is obtained for pressure and air transport as a response to a controlling signal.

15. The element according to claim 1, wherein the sound pitch is modulated to reduce the sound from the element.

16. The element according to claim 1, wherein the microphone comprises an external microphone.

* * * * *